US007730568B2

(12) United States Patent
Wong et al.

(10) Patent No.: US 7,730,568 B2
(45) Date of Patent: Jun. 8, 2010

(54) REMOVAL OF SCALE AND SLUDGE IN A STEAM GENERATOR OF A FABRIC TREATMENT APPLIANCE

(75) Inventors: Nyik Siong Wong, St. Joseph, MI (US); Raveendran Vaidhyanathan, St. Joseph, MI (US); Anthony H. Hardaway, Stevensville, MI (US); Joel A. Luckman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 891 days.

(21) Appl. No.: 11/450,528

(22) Filed: Jun. 9, 2006

(65) Prior Publication Data

US 2007/0283505 A1 Dec. 13, 2007

(51) Int. Cl.
*D06F 33/00* (2006.01)

(52) U.S. Cl. ..... 8/148; 68/5 R

(58) Field of Classification Search ..... 8/158
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz |

(Continued)

FOREIGN PATENT DOCUMENTS

| | | | |
|---|---|---|---|
| CA | 1330526 | C | 7/1994 |

(Continued)

OTHER PUBLICATIONS

V-ZUG Ltd Washing Machine Adora SL; User Manual; V-ZUG AG, CH-6301 Zug, 2004; V-ZUG Ltd Industriestrasse 66, 6301 Zug, Tel. 041 767 67 67.

*Primary Examiner*—Michael Barr
*Assistant Examiner*—Jason P Riggleman
(74) *Attorney, Agent, or Firm*—Clifton G. Green; McGarry Bair P.C.

(57) ABSTRACT

A method of operating a fabric treatment appliance comprises a steam generation step and a steam generator cleaning step. In the steam generator cleaning step, a chamber of the steam generator can be flushed by introducing a volume of liquid into the chamber greater than the internal volume. The steam generator cleaning step can also involve thermally shocking scale formed within the chamber.

11 Claims, 12 Drawing Sheets

U.S. PATENT DOCUMENTS

| | | | | |
|---|---|---|---|---|
| 3,347,066 | A | | 10/1967 | Klausner |
| 3,712,089 | A | | 1/1973 | Toth ..... 68/210 |
| 3,801,077 | A | | 4/1974 | Pearson |
| 3,830,241 | A | | 8/1974 | Dye et al. |
| 3,869,815 | A | | 3/1975 | Bullock |
| 3,890,987 | A | | 6/1975 | Marcussen et al. |
| 3,935,719 | A | | 2/1976 | Henderson |
| 4,020,396 | A | | 4/1977 | Gambale et al. |
| 4,034,583 | A | | 7/1977 | Miessler ..... 68/16 |
| 4,045,174 | A | | 8/1977 | Fuhring et al. |
| 4,108,000 | A | | 8/1978 | Norris |
| 4,177,928 | A | | 12/1979 | Bergkvist |
| 4,207,683 | A | | 6/1980 | Horton ..... 34/60 |
| 4,214,148 | A | | 7/1980 | Fleischauer |
| 4,332,047 | A | | 6/1982 | Kuttelwesch ..... 8/158 |
| 4,373,430 | A | * | 2/1983 | Allen ..... 99/468 |
| 4,386,509 | A | | 6/1983 | Kuttelwesch ..... 68/20 |
| 4,432,111 | A | | 2/1984 | Hoffmann et al. ..... 8/158 |
| 4,489,574 | A | | 12/1984 | Spendel |
| 4,496,473 | A | | 1/1985 | Sanderson |
| 4,646,630 | A | | 3/1987 | McCoy et al. |
| 4,761,305 | A | | 8/1988 | Ochiai |
| 4,777,682 | A | | 10/1988 | Dreher et al. ..... 8/158 |
| 4,784,666 | A | | 11/1988 | Brenner et al. ..... 8/137 |
| 4,809,597 | A | | 3/1989 | Lin |
| 4,879,887 | A | | 11/1989 | Kagi et al. ..... 68/16 |
| 4,920,668 | A | | 5/1990 | Henneberger et al. |
| 4,987,627 | A | | 1/1991 | Cur et al. ..... 8/158 |
| 4,991,545 | A | | 2/1991 | Rabe et al. |
| 5,032,186 | A | | 7/1991 | Childers et al. ..... 134/25 |
| 5,050,259 | A | | 9/1991 | Tsubaki et al. ..... 8/159 |
| 5,052,344 | A | | 10/1991 | Kosugi et al. |
| 5,058,194 | A | | 10/1991 | Violi |
| 5,063,609 | A | * | 11/1991 | Lorimer ..... 392/401 |
| 5,107,606 | A | | 4/1992 | Tsubaki et al. ..... 34/133 |
| 5,146,693 | A | | 9/1992 | Dottor et al. ..... 34/77 |
| 5,152,252 | A | | 10/1992 | Bolton et al. |
| 5,154,197 | A | | 10/1992 | Auld et al. |
| 5,172,654 | A | | 12/1992 | Christiansen |
| 5,172,888 | A | | 12/1992 | Ezekoye |
| 5,199,455 | A | | 4/1993 | Dlouhy |
| 5,212,969 | A | | 5/1993 | Tsubaki et al. ..... 68/19.2 |
| 5,219,370 | A | | 6/1993 | Farrington et al. |
| 5,219,371 | A | | 6/1993 | Shim et al. ..... 8/149 |
| 5,279,676 | A | | 1/1994 | Oslin et al. |
| 5,291,758 | A | | 3/1994 | Lee ..... 68/196 |
| 5,293,761 | A | | 3/1994 | Jang ..... 68/15 |
| 5,315,727 | A | | 5/1994 | Lee ..... 8/159 |
| 5,345,637 | A | | 9/1994 | Pastryk et al. ..... 8/158 |
| 5,570,626 | A | | 11/1996 | Vos |
| 5,619,983 | A | | 4/1997 | Smith |
| 5,727,402 | A | | 3/1998 | Wada |
| 5,732,664 | A | | 3/1998 | Badeaux, Jr. |
| 5,743,034 | A | | 4/1998 | Debourg et al. |
| 5,758,377 | A | | 6/1998 | Cimetta et al. |
| 5,768,730 | A | | 6/1998 | Matsumoto et al. |
| 5,815,637 | A | | 9/1998 | Allen et al. |
| 6,029,300 | A | | 2/2000 | Kawaguchi et al. |
| 6,067,403 | A | | 5/2000 | Morgandi ..... 392/401 |
| 6,094,523 | A | | 7/2000 | Zelina et al. |
| 6,122,849 | A | | 9/2000 | Kida et al. |
| 6,161,306 | A | | 12/2000 | Clodic ..... 34/321 |
| 6,178,671 | B1 | | 1/2001 | Zwanenburg et al. |
| 6,295,691 | B1 | | 10/2001 | Chen |
| 6,434,857 | B1 | | 8/2002 | Anderson et al. |
| 6,451,066 | B2 | | 9/2002 | Estes et al. |
| 6,585,781 | B1 | | 7/2003 | Roseen ..... 8/149.1 |
| 6,622,529 | B1 | | 9/2003 | Crane |
| 6,647,931 | B1 | | 11/2003 | Morgandi et al. |
| 6,691,536 | B2 | | 2/2004 | Severns et al. |
| 6,772,751 | B2 | | 8/2004 | Deuringer et al. |
| 6,789,404 | B2 | | 9/2004 | Kim et al. |
| 6,874,191 | B2 | | 4/2005 | Kim et al. |
| 6,889,399 | B2 | | 5/2005 | Steiner et al. ..... 8/159 |
| 7,021,087 | B2 | | 4/2006 | France et al. |
| 7,096,828 | B2 | | 8/2006 | Tippmann |
| 7,290,412 | B2 | | 11/2007 | Yang et al. |
| 7,325,330 | B2 | | 2/2008 | Kim et al. |
| 7,421,752 | B2 | | 9/2008 | Donadon et al. |
| 7,404,304 | B2 | | 11/2008 | Yang et al. |
| 7,490,491 | B2 | | 2/2009 | Yang et al. |
| 7,490,493 | B2 | | 2/2009 | Kim et al. |
| 7,520,146 | B2 | | 4/2009 | Kim et al. |
| 2001/0032599 | A1 | | 10/2001 | Fischer et al. |
| 2003/0215226 | A1 | | 11/2003 | Nomura et al. |
| 2004/0163184 | A1 | | 8/2004 | Waldron et al. |
| 2004/0187527 | A1 | | 9/2004 | Kim et al. ..... 68/5 |
| 2004/0187529 | A1 | | 9/2004 | Kim et al. ..... 68/207 |
| 2004/0200093 | A1 | | 10/2004 | Wunderlin et al. |
| 2004/0206480 | A1 | | 10/2004 | Maydanik et al. |
| 2004/0237603 | A1 | | 12/2004 | Kim et al. |
| 2004/0244432 | A1 | | 12/2004 | Kim et al. ..... 68/5 |
| 2004/0244438 | A1 | | 12/2004 | North ..... 68/23.2 |
| 2004/0255391 | A1 | | 12/2004 | Kim et al. ..... 8/149 |
| 2005/0028297 | A1 | | 2/2005 | Kim et al. |
| 2005/0034248 | A1 | | 2/2005 | Oh et al. ..... 8/149 |
| 2005/0034249 | A1 | | 2/2005 | Oh et al. ..... 8/159 |
| 2005/0034250 | A1 | | 2/2005 | Oh et al. ..... 8/159 |
| 2005/0034487 | A1 | | 2/2005 | Oh et al. ..... 68/5 |
| 2005/0034488 | A1 | | 2/2005 | Oh et al. ..... 68/5 |
| 2005/0034489 | A1 | | 2/2005 | Oh et al. ..... 68/5 |
| 2005/0034490 | A1 | | 2/2005 | Oh et al. ..... 68/5 |
| 2005/0050644 | A1 | | 3/2005 | Severns et al. |
| 2005/0072382 | A1 | | 4/2005 | Tippmann, Sr. |
| 2005/0072383 | A1 | | 4/2005 | Powell et al. |
| 2005/0092035 | A1 | | 5/2005 | Shin et al. ..... 68/275 |
| 2005/0132503 | A1 | | 6/2005 | Yang et al. ..... 8/149 |
| 2005/0132504 | A1 | | 6/2005 | Yang et al. ..... 8/159 |
| 2005/0132756 | A1 | | 6/2005 | Yang et al. ..... 68/12.15 |
| 2005/0144734 | A1 | | 7/2005 | Yang et al. ..... 8/149.3 |
| 2005/0144735 | A1 | | 7/2005 | Yang et al. ..... 8/149.3 |
| 2005/0144737 | A1 | | 7/2005 | Roepke et al. |
| 2005/0205482 | A1 | | 9/2005 | Gladney |
| 2005/0220672 | A1 | | 10/2005 | Takahashi et al. |
| 2005/0223503 | A1 | | 10/2005 | Hong et al. ..... 8/158 |
| 2005/0223504 | A1 | | 10/2005 | Lee et al. |
| 2005/0252250 | A1 | | 11/2005 | Oh et al. |
| 2005/0262644 | A1 | | 12/2005 | Oak et al. |
| 2006/0000242 | A1 | | 1/2006 | Yang et al. |
| 2006/0001612 | A1 | | 1/2006 | Kim |
| 2006/0005581 | A1 | | 1/2006 | Banba |
| 2006/0010613 | A1 | | 1/2006 | Jeon et al. |
| 2006/0010727 | A1 | | 1/2006 | Fung |
| 2006/0010937 | A1 | | 1/2006 | Kim et al. |
| 2006/0016020 | A1 | | 1/2006 | Park |
| 2006/0090524 | A1 | | 5/2006 | Jeon et al. |
| 2006/0096333 | A1 | | 5/2006 | Park et al. |
| 2006/0101586 | A1 | | 5/2006 | Park et al. |
| 2006/0101588 | A1 | | 5/2006 | Park et al. |
| 2006/0101867 | A1 | | 5/2006 | Kleker |
| 2006/0107468 | A1 | | 5/2006 | Urbanet et al. |
| 2006/0112585 | A1 | | 6/2006 | Choi et al. |
| 2006/0117596 | A1 | | 6/2006 | Kim et al. |
| 2006/0130354 | A1 | | 6/2006 | Choi et al. |
| 2006/0137105 | A1 | | 6/2006 | Hong et al. |
| 2006/0137107 | A1 | | 6/2006 | Lee et al. |
| 2006/0150689 | A1 | | 7/2006 | Kim et al. |
| 2006/0151005 | A1 | | 7/2006 | Kim et al. |
| 2006/0151009 | A1 | | 7/2006 | Kim et al. |
| 2006/0191077 | A1 | | 8/2006 | Oh et al. |
| 2006/0191078 | A1 | | 8/2006 | Kim et al. |
| 2006/0277690 | A1 | | 12/2006 | Pyo et al. |
| 2007/0006484 | A1 | | 1/2007 | Moschuetz et al. |
| 2007/0028398 | A1 | | 2/2007 | Kwon et al. |

| | | | |
|---|---|---|---|
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 3103529 | A1 | 8/1982 |
| DE | 3139466 | A1 | 4/1983 |
| DE | 3501008 | | 7/1986 |
| DE | 4116673 | A1 | 11/1992 |
| DE | 19730422 | A1 | 1/1999 |
| DE | 19736794 | | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 102005051721 | A1 | 5/2007 |
| DE | 102007023020 | B3 | 5/2008 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0287990 | | 10/1988 |
| EP | 0302125 | | 8/1989 |
| EP | 363708 | A2 | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 1163387 | | 12/2001 |
| EP | 1351016 | | 10/2003 |
| EP | 1411163 | | 4/2004 |
| EP | 1437547 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1507033 | A1 | 2/2005 |
| EP | 1529875 | | 5/2005 |
| EP | 1544345 | | 6/2005 |
| EP | 1544345 | A2 * | 6/2005 |
| EP | 1548175 | | 6/2005 |
| EP | 1550760 | | 7/2005 |
| EP | 1555338 | | 7/2005 |
| EP | 1555339 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | A2 | 11/1986 |
| FR | 2688807 | A1 | 9/1993 |
| GB | 191010567 | A | 0/1911 |
| GB | 191010792 | A | 0/1911 |
| GB | 191022943 | A | 0/1911 |
| GB | 191024005 | A | 0/1911 |
| GB | 191103554 | A | 0/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1968 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| GB | 10423 | | 11/2009 |
| GB | 21024 | | 2/2010 |
| JP | 52146973 | | 12/1977 |
| JP | 54068072 | A | 5/1979 |
| JP | 60138399 | A | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |

| | | | |
|---|---|---|---|
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 5346485 | A | 12/1993 |
| JP | 08261689 | | 10/1996 |
| JP | 9133305 | A | 5/1997 |
| JP | 11047488 | A | 2/1999 |
| JP | 2003311068 | | 11/2003 |
| JP | 2003320324 | | 11/2003 |
| JP | 2003326077 | | 11/2003 |
| JP | 2004061011 | | 2/2004 |
| JP | 2004121666 | | 4/2004 |
| JP | 2006109886 | | 4/2006 |
| JP | 2006130295 | A | 5/2006 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | A | 4/2006 |
| WO | 9214954 | | 9/1992 |
| WO | 9307798 | A1 | 4/1993 |
| WO | 9319237 | A1 | 9/1993 |
| WO | 97/15709 | | 5/1997 |
| WO | 98/03175 | | 1/1998 |
| WO | 01/11134 | | 2/2001 |
| WO | 0174129 | A2 | 10/2001 |
| WO | 2001074129 | A2 | 10/2001 |
| WO | 03/012185 | | 2/2003 |
| WO | 03012185 | A2 | 2/2003 |
| WO | 03057966 | | 7/2003 |
| WO | 2004/059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101336 | A1 | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006101377 | A1 | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

REMOVAL OF SCALE AND SLUDGE IN A STEAM GENERATOR OF A FABRIC TREATMENT APPLIANCE

BACKGROUND OF THE INVENTION

1. Field of the Invention

The invention relates to removal of scale and sludge in a steam generator of a fabric treatment appliance.

2. Description of the Related Art

Some fabric treatment appliances, such as a washing machine, a clothes dryer, and a fabric refreshing or revitalizing machine, utilize steam generators for various reasons. The steam from the steam generator can be used to, for example, heat water, heat a load of fabric items and any water absorbed by the fabric items, dewrinkle fabric items, remove odors from fabric items, etc.

A common problem associated with steam generators involves the formation of scale and sludge within the steam generation chamber. Water from a household water supply typically contains dissolved substances, such as calcium and magnesium, which lead to the formation of scale and sludge in the steam generation chamber when the water is heated. Scale and sludge are, respectively, hard and soft deposits; the hard scale tends to deposit on the inner walls of the steam generation chamber, and residue water in the steam generation chamber carries the soft sludge. Formation of scale and sludge can detrimentally affect heat transfer and fluid flow and can lead to premature failure of the heater.

SUMMARY OF THE INVENTION

A method according to one embodiment of the invention of operating a fabric treatment appliance comprising at least one of a tub or drum defining a fabric treatment chamber and a steam generator having a chamber defining an internal volume comprises a steam generation step and a steam generator cleaning step. The steam generation step comprises introducing liquid into the chamber of the steam generator; heating the liquid in the chamber to create steam; and introducing the steam into the fabric treatment chamber. The steam generator cleaning step comprises flushing the chamber by introducing a volume of liquid into the chamber greater than the internal volume.

The introducing of the liquid during the steam generation step can comprise introducing a volume of liquid less than or equal to the internal volume.

The flushing of the chamber can comprise continuously introducing the liquid into the chamber.

The introducing of the liquid during the steam generation step can comprise intermittently introducing the liquid into the chamber.

The steam generator cleaning step can further comprise heating the chamber to a predetermined temperature greater than a liquid to steam phase transformation temperature. The heating of the chamber can evaporate any liquid in the chamber. The predetermined temperature can be about 200° C. The heating of the chamber can occur before the flushing of the chamber. The flushing of the chamber can comprise introducing cold liquid into the chamber. The cold liquid can be liquid from a cold water supply of a household water supply. The introducing of the liquid during the steam generation step can comprise introducing the liquid at a first flow rate, and the flushing of the chamber can comprise introducing the liquid at a second flow rate greater than the first flow rate.

The flushing of the chamber can occur until the temperature of the chamber decreases to a predetermined temperature.

The flushing of the chamber can occur for a predetermined time.

The flushing of the chamber can result in introducing the liquid into the tub.

The flushing of the chamber can occur following at least one of a wash step, a rinse step, a spin step, a drying step, a revitalization step, and a manual user flush command.

A method according to another embodiment of the invention of operating a fabric treatment appliance comprising at least one of a tub or drum defining a fabric treatment chamber and a steam generator having a chamber defining an internal volume comprises heating the chamber to a predetermined temperature greater than a liquid to steam phase transformation temperature and cooling the heated chamber by introducing liquid into the chamber whereby the heating and the cooling of the chamber thermally shocks scale formed within the chamber.

The method can further comprise rinsing the scale from the chamber. The rinsing can comprise continuously introducing liquid into the chamber. The rinsing can comprise flushing the chamber by introducing a volume of liquid into the chamber greater than the internal volume.

The heating of the chamber can evaporate any liquid in the chamber.

The predetermined temperature can be about 200° C.

The liquid introduced into the chamber during the cooling of the chamber can be cold liquid. The cold liquid can be liquid from a cold water supply of a household water supply.

The cooling of the chamber can occur until the temperature of the chamber decreases to a predetermined temperature.

The cooling of the chamber can occur for a predetermined time.

The cooling of the chamber can result in introducing the liquid into the tub.

The heating of the chamber and the cooling of the heated chamber can occur following at least one of a wash step, a rinse step, a spin step, a drying step, a revitalization step, and a manual user flush command.

The method can further comprise generating steam and introducing steam into the fabric treatment chamber prior to the heating of the chamber and the cooling of the heated chamber. The generation of steam can comprise introducing liquid into the chamber and heating the liquid in the chamber to convert the liquid to steam. The introducing of the liquid during the generation of steam can comprise introducing the liquid at a first flow rate, and the introducing of the liquid during the cooling of the heated chamber can comprise introducing the liquid at a second flow rate greater than the first flow rate.

DESCRIPTION OF EMBODIMENTS OF THE INVENTION

To address the problems of scales and sludge, the invention provides methods and structures for preventing formation of and/or removing scale and sludge from a steam generator of a fabric treatment appliance. The fabric treatment appliance can be any machine that treats fabrics, and examples of the fabric treatment appliance include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing machine; an extractor; a non-aqueous washing apparatus; and a revitalizing machine. For illustrative purposes, the invention will be described with respect to a washing machine, with it being understood that the invention can be adapted for use with any type of fabric treatment appliance having a steam generator.

Figure 1:
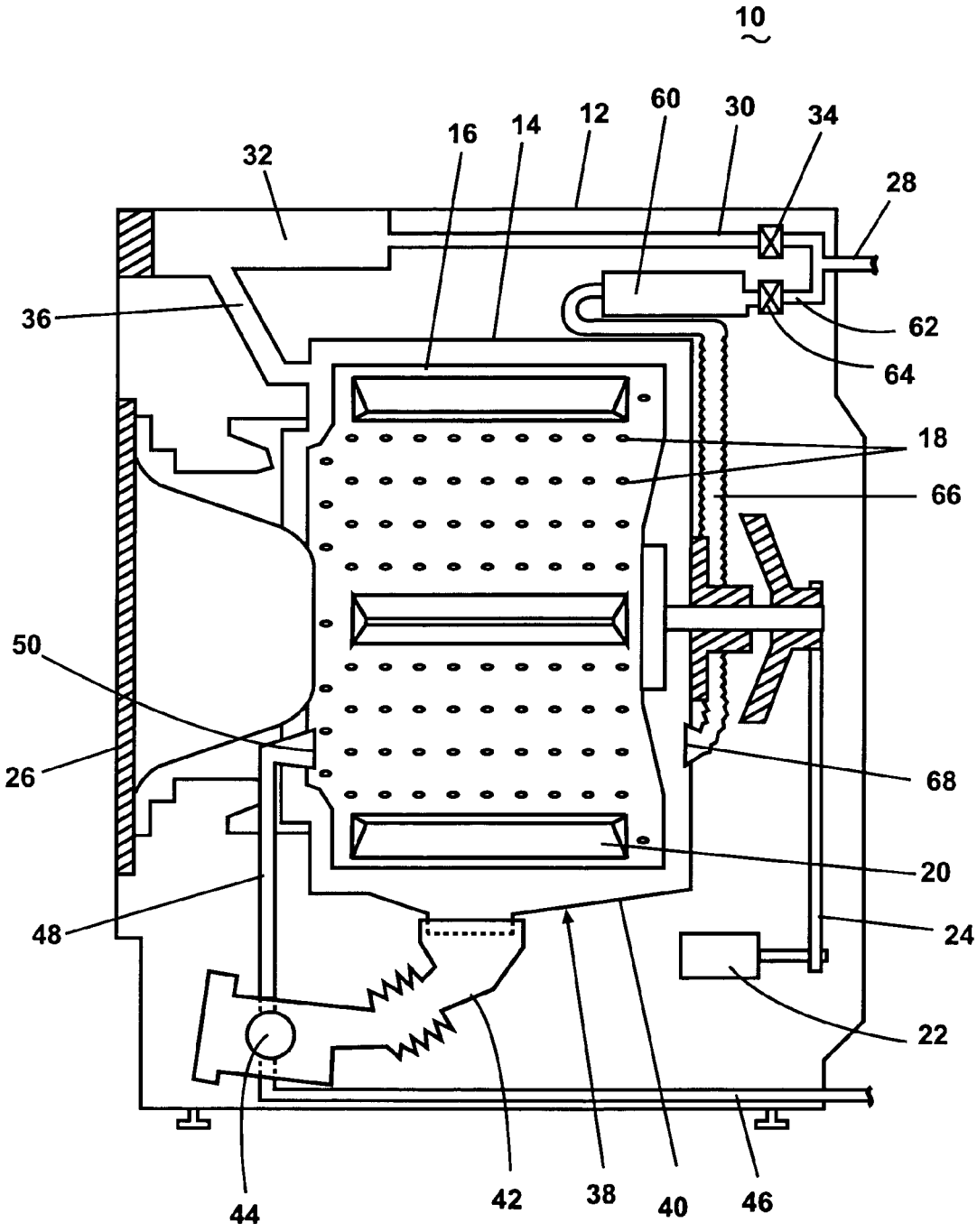
FIG. 1 is a schematic view of a steam washing machine according to one embodiment of the invention.

Referring now to the figures, FIG. 1 is a schematic view of an exemplary steam washing machine 10. The washing machine 10 comprises a cabinet 12 that houses a stationary tub 14. A rotatable drum 16 mounted within the tub 14 defines a fabric treatment chamber and includes a plurality of perforations 18, and liquid can flow between the tub 14 and the drum 16 through the perforations 18. The drum 16 further comprises a plurality of baffles 20 disposed on an inner surface of the drum 16 to lift fabric items contained in the drum 16 while the drum 16 rotates, as is well known in the washing machine art. A motor 22 coupled to the drum 16 through a belt 24 rotates the drum 16. Both the tub 14 and the drum 16 can be selectively closed by a door 26.

Washing machines are typically categorized as either a vertical axis washing machine or a horizontal axis washing machine. As used herein, the "vertical axis" washing machine refers to a washing machine comprising a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. The illustrated exemplary washing machine of FIG. 1 is a horizontal axis washing machine.

The motor 22 can rotate the drum 16 at various speeds in opposite rotational directions. In particular, the motor 22 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the baffles 20. Alternatively, the motor 22 can rotate the drum 16 at spin speeds wherein the fabric items rotate with the drum 16 without falling.

The washing machine 10 of FIG. 1 further comprises a liquid supply and recirculation system. Liquid, such as water, can be supplied to the washing machine 10 from a household water supply through a liquid inlet 28. A first supply conduit 30 fluidly couples the liquid inlet 28 to a detergent dispenser 32. A first inlet valve 34 controls flow of the liquid from the liquid inlet 28 and through the first supply conduit 30 to the detergent dispenser 32. The first inlet valve 34 can be positioned in any suitable location between the liquid inlet 28 and the detergent dispenser 32. A liquid conduit 36 fluidly couples the detergent dispenser 32 with the tub 14. The liquid conduit 36 can couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and flows by gravity to a sump 38 formed in part by a lower portion 40 of the tub 14. The sump 38 is also formed by a sump conduit 42 that fluidly couples the lower portion 40 of the tub 14 to a pump 44. The pump 44 can direct fluid to a drain conduit 46, which drains the liquid from the washing machine 10, or to a recirculation conduit 48, which terminates at a recirculation inlet 50. The recirculation inlet 50 directs the liquid from the recirculation conduit 48 into the drum 16. The recirculation inlet 50 can introduce the liquid into the drum 16 in any suitable manner, such as by spraying, dripping, or providing a steady flow of the liquid.

The exemplary washing machine 10 further includes a steam generation system. The steam generation system comprises a steam generator 60 that receives liquid from the liquid inlet 28 through a second supply conduit 62. A second inlet valve 64 controls flow of the liquid from the liquid inlet 28 and through the second supply conduit 62 to the steam generator 60. The second inlet valve 64 can be positioned in any suitable location between the liquid inlet 28 and the steam generator 60. A steam conduit 66 fluidly couples the steam generator 60 to a steam inlet 68, which introduces steam into the tub 14. The steam inlet 68 can couple with the tub 14 at any suitable location on the tub 14 and is shown as being coupled to a rear wall of the tub 14 in FIG. 1 for exemplary purposes. According to one embodiment of the invention, the steam inlet 68 is positioned at a height higher than a level corresponding to a maximum level of the liquid in the tub 14 to prevent backflow of the liquid into the steam conduit 66. The steam that enters the tub 14 through the steam inlet 68 subsequently enters the drum 16 through the perforations 18. Alternatively, the steam inlet 68 can be configured to introduce the steam directly into the drum 16. The steam inlet 68 can introduce the steam into the tub 14 in any suitable manner. The washing machine 10 can further include an exhaust conduit that directs steam that leaves the tub 14 externally of the washing machine 10. The exhaust conduit can be configured to exhaust the steam directly to the exterior of the washing machine 10. Alternatively, the exhaust conduit can be configured to direct the steam through a condenser prior to leaving the washing machine 10.

The steam generator 60 can be any type of device that converts the liquid to steam. For example, the steam generator 60 can be a tank-type steam generator that stores a volume of liquid and heats the volume of liquid to convert the liquid to steam. Alternatively, the steam generator 60 can be an in-line steam generator that converts the liquid to steam as the liquid flows through the steam generator 60. The steam generator 60 can produce pressurized or non-pressurized steam.

In addition to producing steam, the steam generator 60, whether an in-line steam generator, a tank-type steam generator, or any other type of steam generator, can heat water to a temperature below a steam transformation temperature, whereby the steam generator 60 produces hot water. The hot water can be delivered to the tub 14 and/or drum 16 from the steam generator 60. The hot water can be used alone or can optionally mix with cold water in the tub 14 and/or drum 16. Using the steam generator to produce hot water can be useful when the steam generator 60 couples only with a cold water source at the liquid inlet 28.

Figure 2:
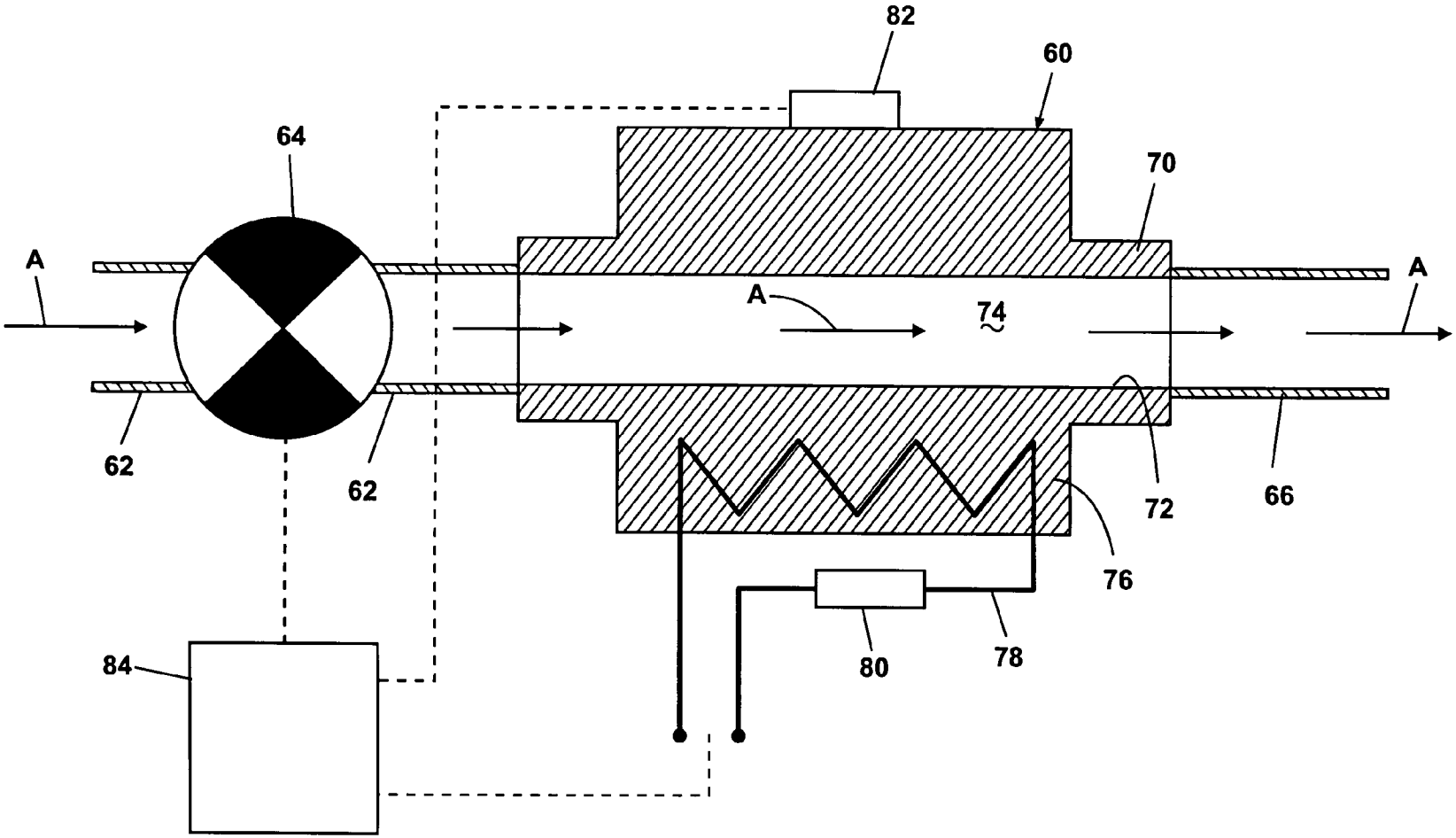
FIG. 2 is a schematic view of a first embodiment steam generator according to one embodiment of the invention for use with the washing machine of FIG. 1.

FIG. 2 is a schematic view of an exemplary in-line steam generator 60 for use with the washing machine 10. The steam generator 60 comprises a housing or main body 70 in the form of a generally cylindrical tube. The main body 70 has an inside surface 72 that defines a steam generation chamber 74. The steam generation chamber 74 is fluidly coupled to the second supply conduit 62 such that fluid from the second supply conduit 62 can flow through the second inlet valve 64 and can enter the steam generation chamber 74. The second inlet valve 64 can be configured to supply the fluid to the steam generator 60 in any suitable manner. For example, the fluid can be supplied in a continuous manner or according to a duty cycle where the fluid is supplied for discrete periods of time when the second inlet valve 64 is open separated by discrete periods of time when the second inlet valve 64 is closed. Thus, for the duty cycle, the periods of time when the fluid can flow through the second inlet valve 64 alternate with the periods of time when the fluid cannot flow through the second inlet valve 64. The steam generation chamber 74 is also fluidly coupled to the steam conduit 66 such that steam generated in the steam generation chamber 74 can flow into the steam conduit 66. The flow of fluid into and steam out of the steam generation chamber 74 is represented by arrows A in FIG. 2.

The steam generator 60 can be coupled to the steam conduit 66 in any suitable manner. In the illustrated embodiment of FIG. 2, the steam generator main body 70 joins with the steam conduit 66 in a generally horizontal manner. As an alternative, the steam generator 60 can be configured with an ascending outlet coupled to the steam conduit 66 to prevent water below a certain volume in the steam generation chamber 74 from flowing into the steam conduit 66, or the steam generator 60 can have a vertically oriented outlet or can be vertically oriented to achieve the same effect.

The steam generator 60 further comprises a heater body 76 and a heater 78 embedded in the heater body 76. The heater body 76 is made of a material capable of conducting heat. For example, the heater body 76 can be made of a metal, such as aluminum. The heater body 76 of the illustrated embodiment is shown as being integrally formed with the main body 70, but it is within the scope of the invention for the heater body 76 to be formed as a component separate from the main body 70. In the illustrated embodiment, the main body 70 can also be made of a heat conductive material, such as metal. As a result, heat generated by the heater 78 can conduct through the heater body 76 and the main body 70 to heat fluid in the steam generation chamber 74. The heater 78 can be any suitable type of heater, such as a resistive heater, configured to generate heat. A thermal fuse 80 can be positioned in series with the heater 78 to prevent overheating of the heater 78. Alternatively, the heater 78 can be located within the steam generation chamber 74 or in any other suitable location in the steam generator 60.

The steam generator 60 further includes a temperature sensor 82 that can sense a temperature of the steam generation chamber 74 or a temperature representative of the temperature of the steam generation chamber 74. The temperature sensor 82 of the illustrated embodiment is coupled to the heater body 76; however, it is within the scope of the invention to employ temperature sensors in other locations. For example, the temperature sensor 82 can be a probe-type sensor that extends through the inside surface 72 into the steam generation chamber 74. However, it has been found that the temperature of the heater body 76 is representative of the temperature of the steam generation chamber 74 in that there is a relationship between the two temperatures. The temperature sensor 82, the heater 78, and the second inlet valve 64 can be coupled to a controller 84, which can control the operation of heater 78 and the second inlet valve 64 in response to information received from the temperature sensor 82.

The liquid supply and recirculation system and the steam generator system can differ from the configuration shown in FIG. 1, such as by inclusion of other valves, conduits, wash aid dispensers, and the like, to control the flow of liquid and steam through the washing machine 10 and for the introduction of more than one type of detergent/wash aid. For example, a valve can be located in the liquid conduit 36, in the recirculation conduit 48, and in the steam conduit 66. Furthermore, an additional conduit can be included to couple the liquid inlet 28 directly to the tub 14 or the drum 16 so that the liquid provided to the tub 14 or the drum 16 does not have to pass through the detergent dispenser 32. Alternatively, the liquid can be provided to the tub 14 or the drum 16 through the steam generator 60 rather than through the detergent dispenser 32 or the additional conduit. As another example, the recirculation conduit 48 can be coupled to the liquid conduit 36 so that the recirculated liquid enters the tub 14 or the drum 16 at the same location where the liquid from the detergent dispenser 32 enters the tub 14.

The washing machine 10 can further comprise a machine controller coupled to various working components of the washing machine 10, such as the pump 44, the motor 22, the first and second inlet valves 34, 64, the detergent dispenser 32, and the steam generator 60 to control the operation of the washing machine 10. The machine controller can receive data from the working components and can provide commands, which can be based on the received data, to the working components to execute a desired operation of the washing machine 10.

The washing machine of FIG. 1 is provided for exemplary purposes only. It is within the scope of the invention to perform the inventive methods on other types of washing machines, examples of which are disclosed in: our Docket Number US20050365, titled "Method of Operating a Washing Machine Using Steam;" our Docket Number US20060177, titled "Steam Washing Machine Operation Method Having Dual Speed Spin Pre-Wash;" and our Docket Number US20060178, titled "Steam Washing Machine Operation Method Having Dry Spin Pre-Wash," all filed concurrently herewith and incorporated herein by reference in their entirety.

Figure 3:
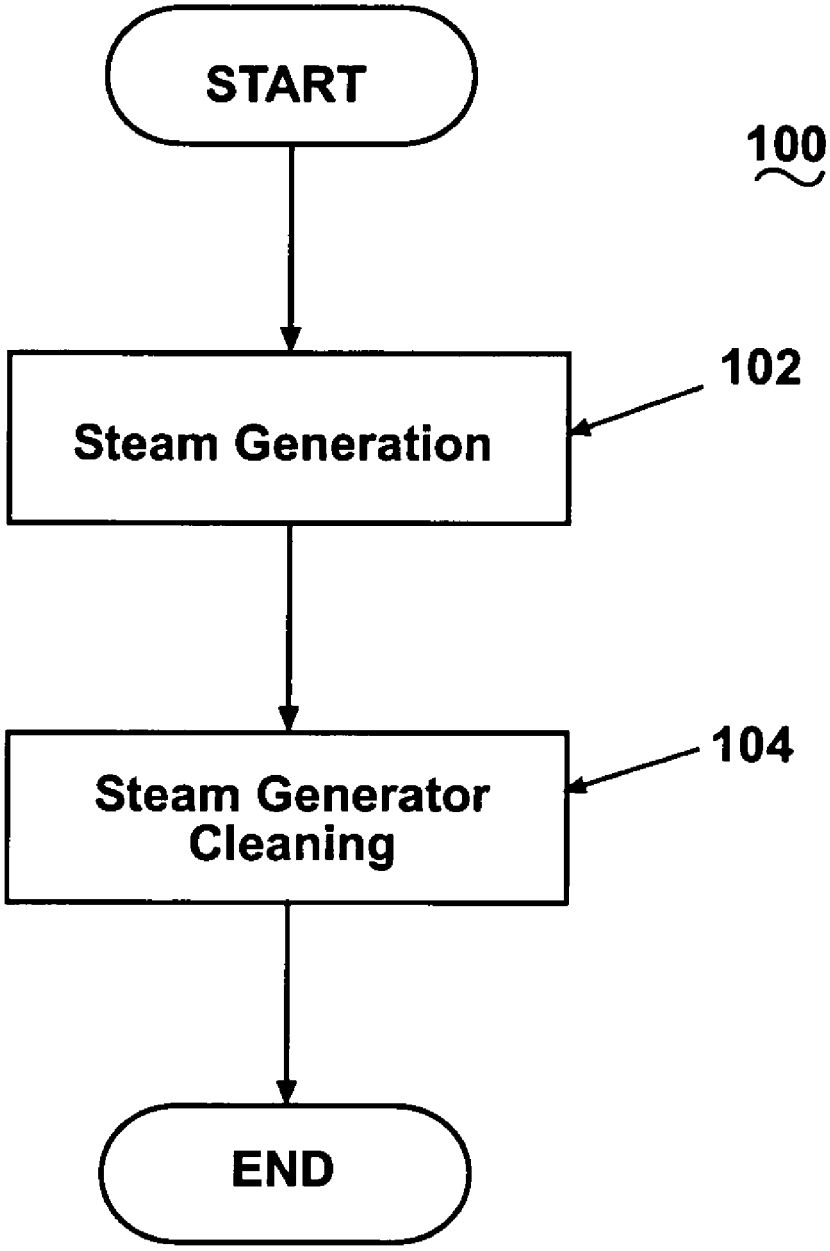
FIG. 3 is a flow chart of a method of operating the steam washing machine of FIG. 1 according to one embodiment of the invention, wherein the method comprises a steam generation step and a steam generator cleaning step.

A method 100 of operating the washing machine 10 according to one embodiment of the invention is illustrated in the flow chart of FIG. 3. In general, the method 100 comprises a steam generation step 102 and a steam generator cleaning step 104. The steam generator cleaning step 104 can occur immediately following the steam generation step 102, or the steam generator cleaning step 104 can occur at any other suitable time, such as at any time following the completion of the steam generation step 102 or independently of the steam generation step 102 (i.e., the steam generation step 102 is not necessary for execution of the steam generator cleaning step 104).

During the steam generation step 102, the steam generator 60 receives water and converts the water to steam, which is introduced into the tub 14 and/or drum 16. The steam generation step 102 can proceed in any suitable manner to accomplish the conversion of water to steam. An exemplary execution of the steam generation step 102, which can be employed with the steam generator 60 shown in FIG. 2 or any other suitable steam generator, is presented in the flow chart of FIG. 4.

Figure 4:
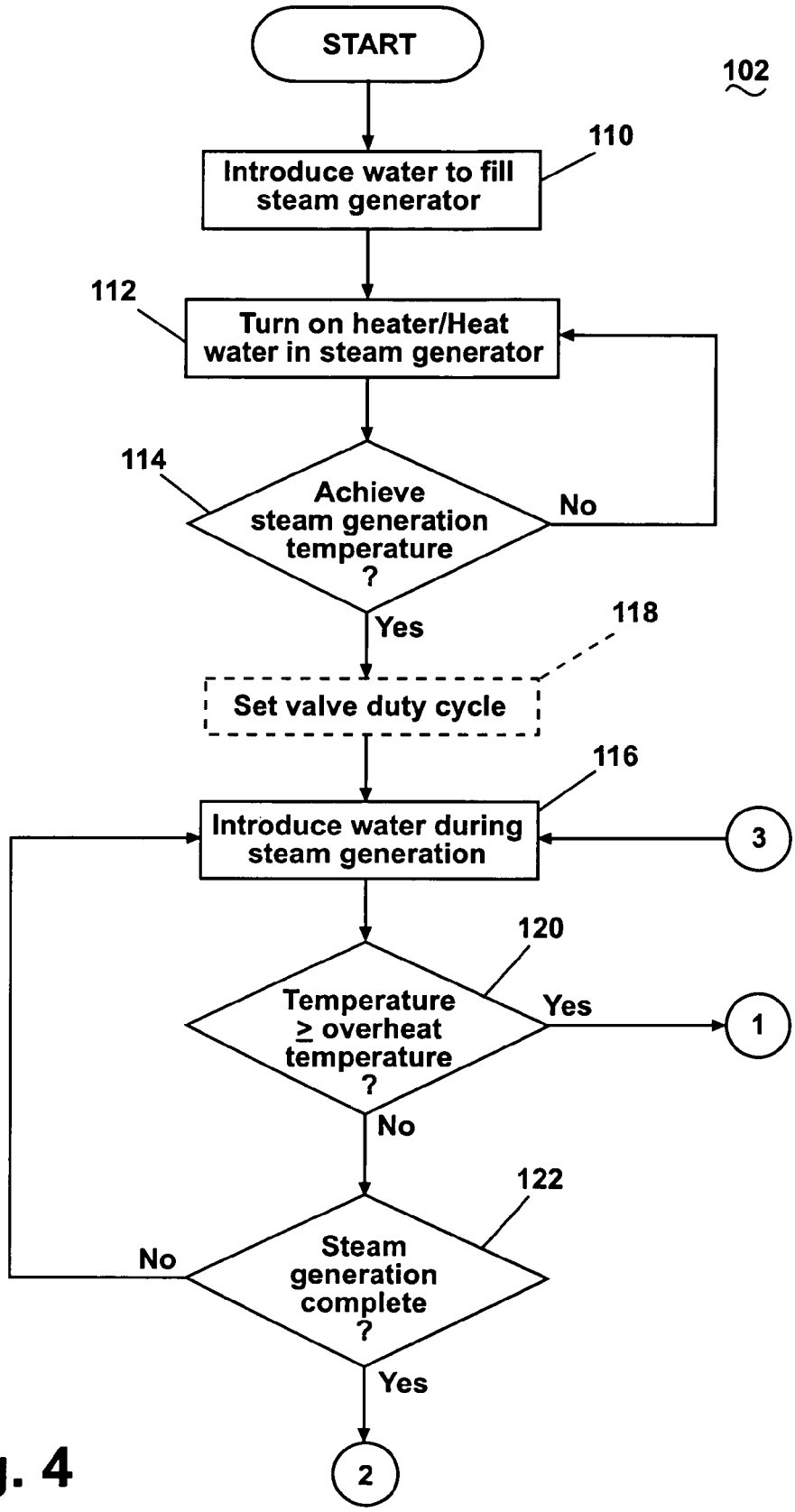
FIG. 4 is a flow chart of an exemplary execution of the steam generation step of the method of FIG. 3.

Referring now to FIG. 4, the exemplary execution of the steam generation step 102 begins by introducing water into the steam generator 60 to fill the steam generation chamber 74 in step 110. The filling of the steam generation chamber 74 can be accomplished by opening the second supply valve 64 for a continuous flow of water through the second supply conduit 62 to the steam generation chamber 74. In the illustrated embodiment of the steam generator 60 in FIGS. 1 and 2, any water overflowing from the steam generation chamber 74 flows through the steam conduit 66 to the tub 14, where the water can flow directly to the sump 38 without entering the drum 16. Alternatively, the steam generator 60 can include an outlet valve that prevents the water from flowing out of the steam generation chamber 74. In the step 110, the water can be introduced until the steam generation chamber 74 is sufficiently full, which can be determined, for example, by a water level sensor in the steam generator 60 or by introducing the water for a predetermined period of time. For example, for a water flow rate of about 30 g/min achieved with about a 0.25 liter per minute flow rate for the second inlet valve 64 and a 1300 watt steam generator with a volume of less than about 125 cc, a suitable predetermined period of time can be about 30 seconds. "Sufficiently full" need not correspond to completely filling the steam generation chamber 74 with water; rather, the steam generation chamber 74 can be filled with a volume equal to or less than an internal volume of the steam generation chamber 74.

After the steam generation chamber 74 is sufficiently filled with water, the introduction of water ceases, and the heater 78 is turned on in step 112 to heat the water in the steam generation chamber 74. Waiting to turn the heater 78 on until the steam generation chamber 74 is sufficiently full ensures that there is enough water in the steam generation chamber 74 to prevent damage to the heater. However, it is within the scope of the invention to turn the heater 78 on while the water is being introduced in the step 110. The temperature sensor 82 monitors the temperature of the steam generation chamber 74, and the controller 84 evaluates whether the temperature of the steam generation chamber 74 has reached a steam generation temperature in step 114. The steam generation temperature depends on environmental conditions, such as the pressure of the environment. For example, for an atmospheric pressure of about 1 atm (760 mm Hg), the steam generation temperature is about 100° C. If the temperature of the steam generation chamber 74 has not yet reached the steam generation temperature, then the steam generation step 102 continues with the step 112 of heating the water in the steam generation chamber 74.

Conversely, if the temperature of the steam generation chamber 74 has reached the steam generation temperature, then the water converts to steam, and the steam generation step 102 proceeds to step 116 of introducing water into the steam generation chamber 74 to replenish the water converting to steam and leaving the steam generation chamber 74 for introduction into the tub 14 and/or the drum 16. With the illustrated embodiment of the steam generator 60 in FIGS. 1 and 2, the introducing of the water can be accomplished by operating the second supply valve 64 according to a duty cycle set by the controller 84 in step 118 prior to the introduction of the water in the step 116. The duty cycle can be selected to ensure that a sufficient amount of water is present in the steam generation chamber 74 to prevent overheating of the steam generation chamber 74.

An exemplary duty cycle for the above example of a 0.25 liter per minute valve flow rate and 1300 watt steam generator comprises an "on" period (i.e., the second supply valve 64 is open) of about 1 second that alternates with an "off" period (i.e., the second supply valve 64 is closed) of about 9 seconds to achieve an average water dosing of about 30 g/min. The step 116 of setting the valve duty cycle is shown in a box having dashed lines because this step can be eliminated or altered depending, for example, on the type and number of valves controlling the introduction of water into the steam generation chamber 74.

While the water is introduced into the steam generation chamber 74 and converted to steam, the temperature sensor 82 monitors the temperature of the steam generation chamber 74, and the controller 84 evaluates whether the temperature of the steam generation chamber 74 has reached an overheat temperature in step 120. The overheat temperature is a predetermined temperature sufficiently high to potentially damage the heater 78 and the steam generator 60. As an example, the overheat temperature can be about 200° C. If the temperature of the steam generation chamber 74 reaches or exceeds the overheat temperature, then an overheat protection step 130, which is described below, can be executed. If the temperature remains below the overheat temperature, then the introduction of water and generation of steam continues until the steam generation step 102 is complete. The completion of the steam generation step 102 is evaluated in step 122. For example, the steam generation step 102 can be considered complete after a predetermined period of time has elapsed or once the fabric in the drum 16 reaches a predetermined temperature. If the steam generation step 102 is complete, the method 100 proceeds to the steam generator cleaning step 104.

Figure 5:
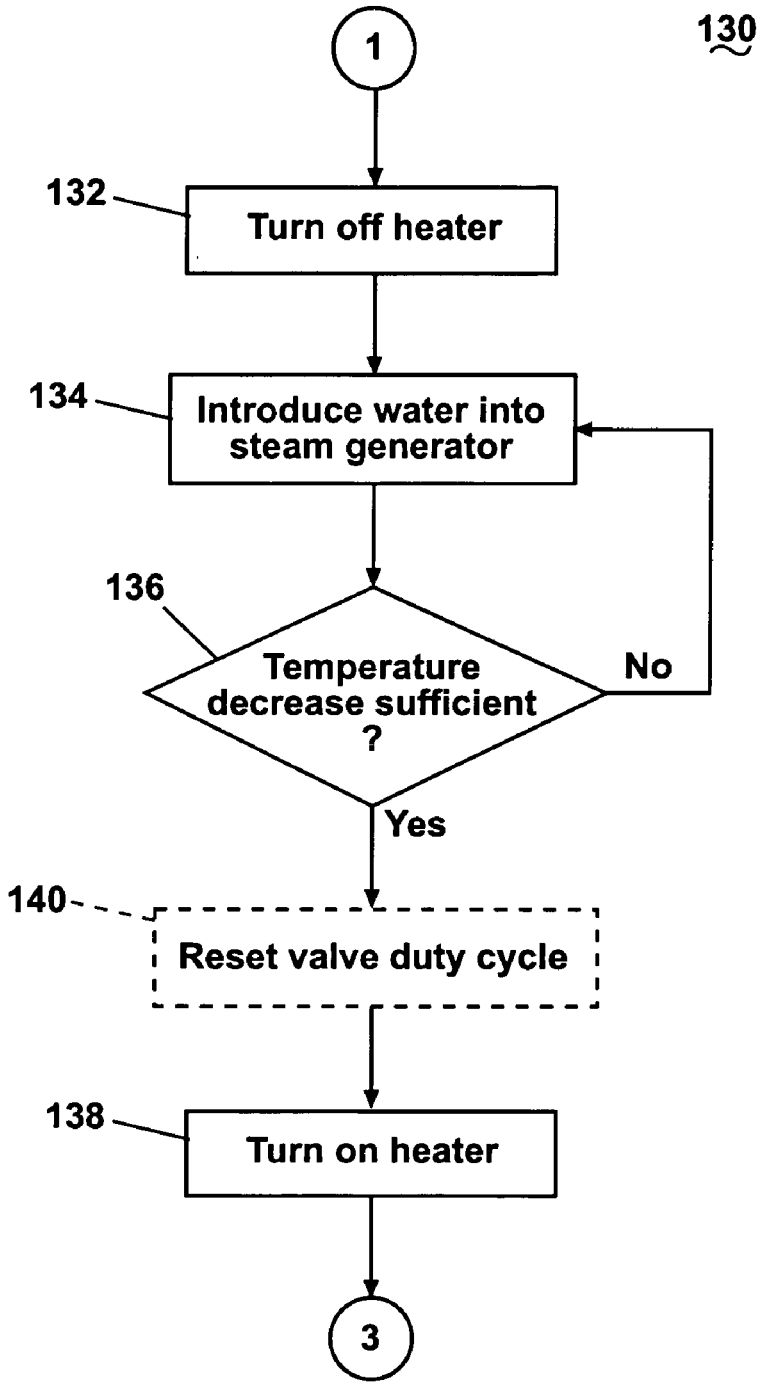
FIG. 5 is a flow chart of an exemplary execution of an overheat protection step of the method of FIG. 3.

The overheat protection step 130 reduces the temperature of the steam generation chamber 74 and thereby prevents damage to the steam generator 60, particularly the heater 78. An exemplary execution of the overheat protection step 130 is provided in the flow chart of FIG. 5. The exemplary execution of the overheat protection step 130 begins with turning off the heater in step 132 and introducing water into the steam generation chamber 74 in step 134. The introducing of the water can be accomplished by opening the second supply valve 64 to provide a continuous flow of water through the steam generation chamber 74. The temperature of the steam generation chamber 74 decreases because of heat transfer to the water flowing through the steam generation chamber 74.

The temperature sensor 82 monitors the temperature of the steam generation chamber 74, and the controller 84 evaluates whether the temperature of the steam generation chamber 74 has decreased sufficiently in step 136. The amount of temperature decrease corresponds to a safe operating temperature for the steam generator 60 and can depend on the type and size of the steam generator 60. The introduction of water continues in the step 134 until it is has been determined in the step 136 that the temperature decrease is sufficient. If a predetermined time has elapsed without a sufficient decrease in temperature, the steam generator 60 can cease operation, and an alert can be communicated to the user. Otherwise, after the temperature has sufficiently decreased, the overheat protection step 130 continues by turning off the heater 78 in step 138 and returning to the steam generation step 102, such as to the step 116 of introducing water during steam generation.

Prior to returning to the steam generation step 102, the overheat protection step 130 can include a step 140 of resetting the duty cycle of the second supply valve 64. The duty cycle can be reset so that a larger amount of water is provided to the steam generation chamber 74 in a given time period to thereby avoid overheating the steam generator 60 due to excessive reduction of the water in the steam generation chamber 74. For example, the above exemplary duty cycle can be reset by increasing the "on" period by 0.25 seconds and reducing the "off" period by 0.25 seconds to result in an "on" period of about 1.25 second that alternates with an "off" period of about 8.75 seconds. The step 140 of setting the valve duty cycle is shown in a box having dashed lines because this step can be eliminated or altered depending on, for example, the type and number of valves controlling the introduction of water into the steam generation chamber 74.

During the steam generator cleaning step 104, water is introduced into the steam generation chamber 74 to remove scale and/or sludge formed in the steam generation chamber 74. Introducing the water into the steam generation chamber 74 can also replace water already present in the steam generation chamber 74 with fresh water. The water already present in the steam generation chamber 74 has a relatively high content of soluble minerals due to the heating of the water in the steam generation step 102, and replacing the water already present in the steam generation chamber 74 with the fresh water, which has a relatively low content of soluble minerals, reduces the likelihood of scale and/or sludge formation. The introduction of water can optionally be preceded by a heating of the steam generation chamber 74, which heats the scale formed along the inside surface 72 of the steam generation chamber 74. The introduction of the water after the heating of the steam generation chamber 74 quickly cools the heated steam generation chamber 74 and thermally shocks the scale. The thermal shock can cause the scale to delaminate from the inside surface 72, and the water can rinse the loose scale out of the steam generator 60. The steam generator cleaning step 104 can proceed in any suitable manner to accomplish the cleaning of the steam generation chamber 74. Exemplary executions of the steam generator cleaning step 104, which can be employed with the steam generator 60 shown in FIG. 2 or any other suitable steam generator, are presented in the flow charts of FIGS. 6 and 7. The exemplary execution of FIG. 6 comprises the introduction of the water, while the exemplary execution of FIG. 7 adds the thermal shock before the introduction of water. The exemplary executions assume that the steam generator cleaning step 104 immediately follows the steam generation step 102; however, as explained above, it is not necessary for the steam generation step 102 to immediately precede the steam generator cleaning step 104.

Figure 6:
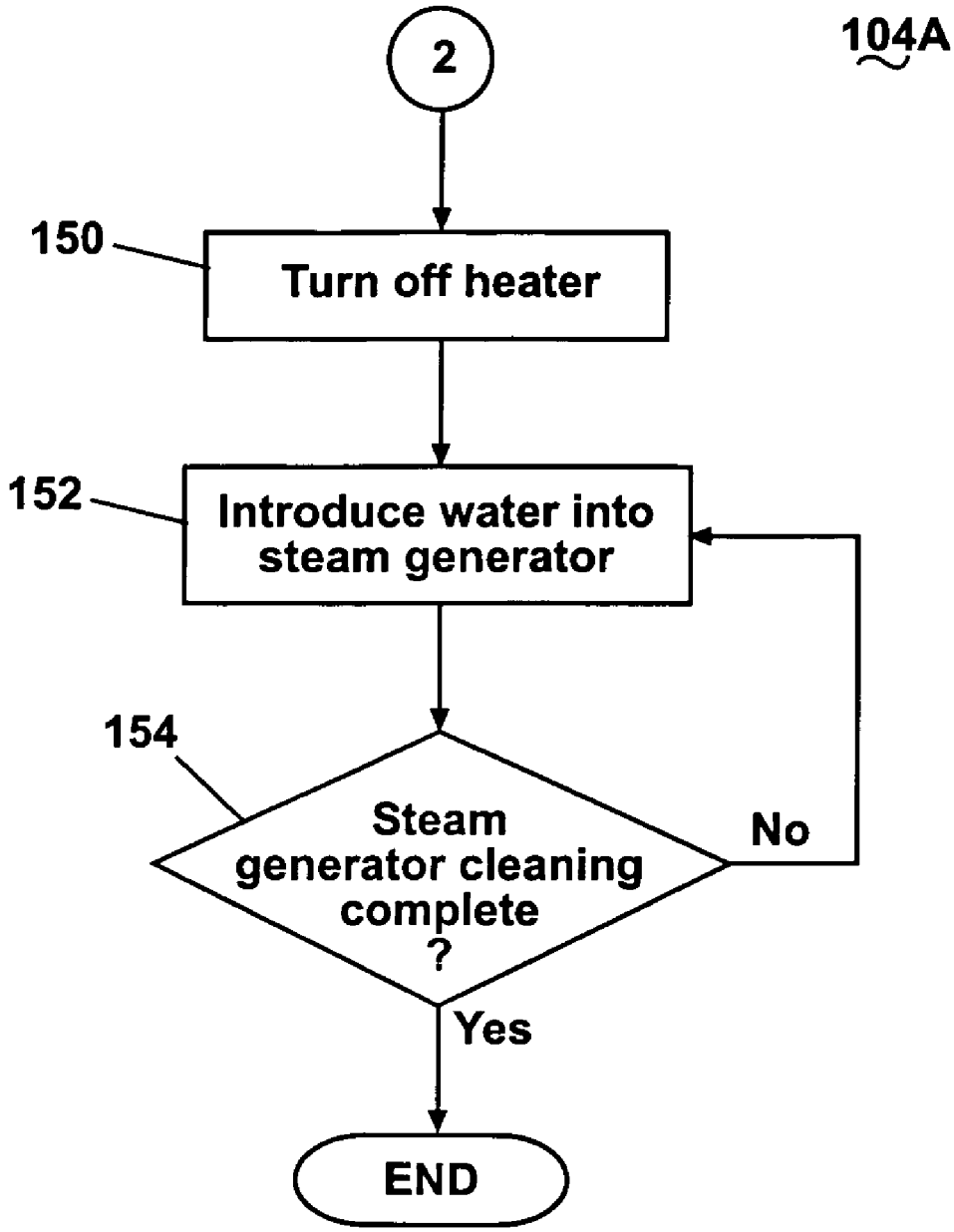
FIG. 6 is a flow chart of a first exemplary execution of the steam generator cleaning step of the method of FIG. 3.

Referring now to FIG. 6, a first exemplary execution of the steam generator cleaning step 104A begins with turning off the heater 150 in step 150 and introducing water into the steam generation chamber 74 in step 152. The flow of water through the steam generation chamber 74 rinses scale and sludge formed in the steam generation chamber 74 when the water was heated during the steam generation step 102. The water can be introduced into the steam generation chamber 74 in any suitable manner. For example, the steam generation chamber 74 can be flushed with the water, whereby a volume of water greater than an internal volume of the steam generation chamber 74 is introduced. To accomplish the flushing, the second supply valve 64 can be opened to provide a continuous flow of water into the steam generator 60. As a result, the introduced water forces water remaining in the steam generator 60 after the steam generation step 102 to flow out of the steam generation chamber 74 and carry the scale and sludge out of the steam generation chamber 74. In the illustrated embodiment of FIGS. 1 and 2, the water, along with the scale and the sludge, flows through the steam conduit 66 and into the tub 14. Because the steam conduit 66 couples with the tub 14 at a rear portion of the tub 14, the water, along with the scale and the sludge, flows to the sump 38 without entering the drum 16. The rear portion of the drum 16 shields the fabric treatment chamber from the water, scale, and sludge mixture. Once in the sump 38, the water, along with the scale and sludge, can exit the washing machine 10 via the pump 44 and the drain conduit 46. Consequently, the water, scale, and sludge, does not contact fabric items in the drum 16 when flowing from the steam generator 60 to the sump 38, and the steam generator cleaning step 104 can be performed at any time, even when fabric items are present in the drum 16. Furthermore, if the steam generator 60 is positioned above the connection between the steam conduit 66 and the tub 14, then the water can flow to the tub 14 by gravity. Such is the case in the illustrated embodiment as the steam generator 60 is positioned above the tub 14.

In step 154, the controller 84 determines whether the steam generator cleaning step 104A is complete. The determination of whether the steam generator cleaning step 104A is complete can be made in any suitable manner. For example, the steam generator cleaning step 104A can be considered complete after a predetermined period of time has elapsed, or, alternatively, after the temperature of the steam generation chamber 74, as sensed by the temperature sensor 82, has been reduced to a predetermined temperature, such as ambient temperature. The method 100 ends when it has been determined that the steam generation step 104A is complete.

Figure 7:
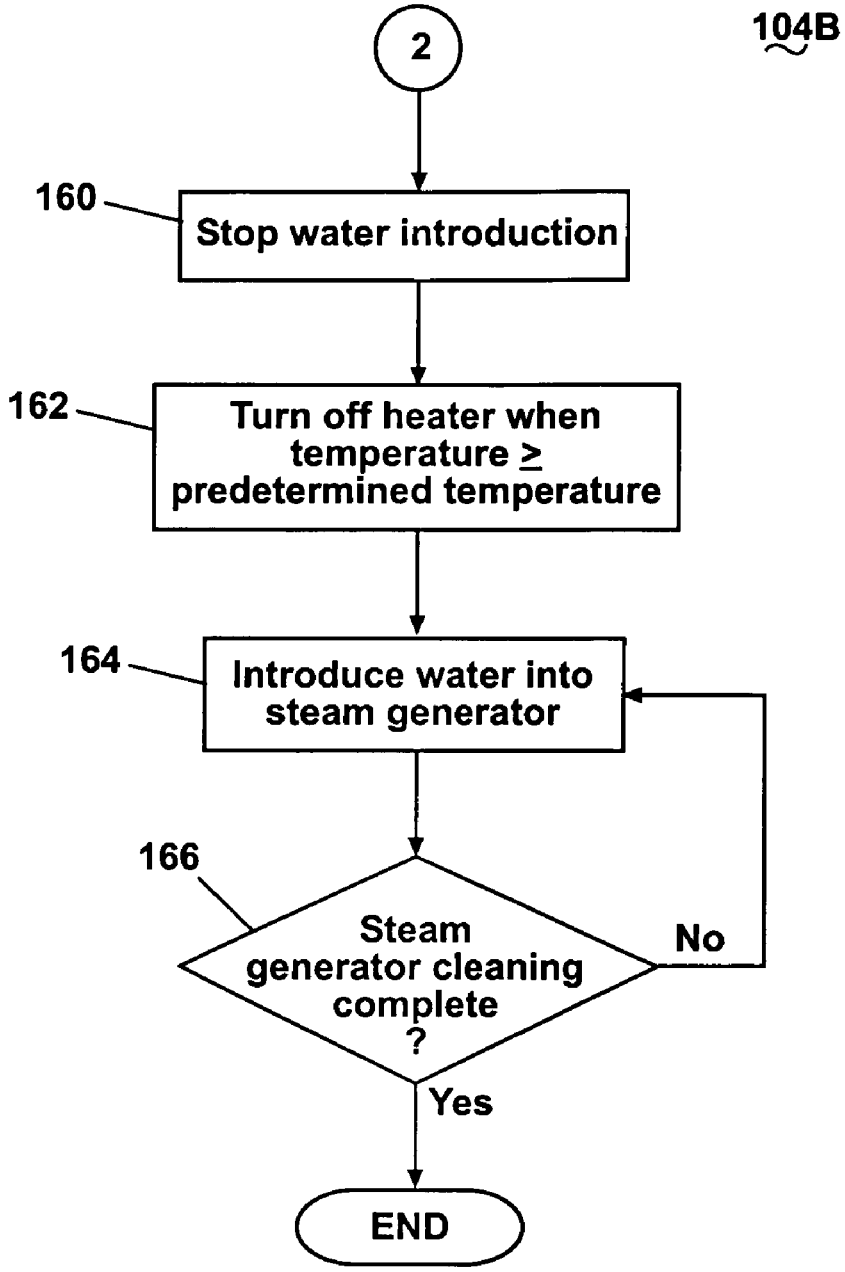
FIG. 7 is a flow chart of a second exemplary execution of the steam generator cleaning step of the method of FIG. 3.

Referring now to FIG. 7, a second exemplary execution of the steam generator cleaning step 104B begins with stopping the introduction of water in step 160. Assuming that the second exemplary execution of the steam generator cleaning step 104B occurs at the end of the steam generating step 102, the heater 78 is active. If the heater 78 is not active, then the heater 78 is turned on to heat the steam generation chamber 74. As the temperature of the steam generation chamber 74 increases, water remaining in the steam generation chamber 74 from the steam generation step 102 evaporates, and eventually the steam generation chamber 74 contains no water.

The heater 78 remains active until the temperature of the steam generation chamber 74, as determined by the temperature sensor 82, becomes equal to or greater than a predetermined temperature greater than the steam generation temperature. An exemplary predetermined temperature is about 200° C. When the steam generation chamber 74 reaches the predetermined temperature, the heater 78 is turned off in step 162. The portion of the second exemplary execution of the steam generator cleaning step 104B described thus far can be considered a heating portion of the steam generation cleaning step 104B.

The remaining portion of the steam generator cleaning step 104B can be considered a cooling portion and comprises step 164 of introducing water into the steam generation chamber 74 and step 166 of determining whether the steam generator cleaning step 104B is complete. The steps 164, 166 are essentially identical to the steps 152, 154 described above for the first exemplary execution of the steam generator cleaning step 104A. According to one embodiment of the invention, the water introduced in the step 164 is cold water so that a significant temperature differential exists between the temperature of the water and the temperature of the steam generation chamber 74. For example, the cold water can be the cold water source of a household water source, which typically has a cold water source and a warm or hot water source. As a result of the temperature differential, the cold water thermally shocks the heated scale formed on the inside surface 72 of the steam generation chamber 74. The scale cracks and delaminates from the inside surface 72 and is rinsed by the water flowing through the steam generation chamber 74.

As stated above, with the illustrated embodiment of the washing machine 10 in FIG. 1, the water, scale, and sludge mixture that leaves the steam generator 60 flows through the steam conduit 66 and into the tub 14. Because the water, scale, and sludge mixture enters the tub 14 at a location where the water, scale, and sludge mixture does not enter the drum 16 and, therefore, does not contact fabric items in the drum 16, the steam generator cleaning step 104 can be conducted at any time. For example, in the case where the fabric treatment appliance is the washing machine 10, the steam generator cleaning step 104 can be performed at any time during a wash cycle, including before, during, or after a pre-wash step, a wash step, a rinse step, and a spin or dewater step. When the fabric treatment appliance is another type of appliance, the steam generator cleaning step 104 can be performed, for example, before, during, or after a revitalizing step, a refreshing step, and a drying step. Optionally, the steam generator cleaning step 104 can be executed upon input of a manual command by a user or automatically at predetermined time intervals, such as weekly or monthly.

The steam generator cleaning step 104 can also be considered a draining step because water remaining in the steam generation chamber 74 after the steam generation step 102 drains out of the steam generation chamber 74 in the steam generator cleaning step 104. When considered a draining step, the steam generator cleaning step 104 can include the step 152, 164 of introducing the water into the steam generation chamber 74, or the water remaining in the steam generation chamber 74 after the steam generation step 102 can simply be drained from the steam generation chamber 74 without the introduction of water. In this way, the steam conduit 66 of the illustrated embodiment of FIGS. 1 and 2 also acts as a drain conduit, whereby the drain is coupled to the tub 14. As stated above with respect to the illustrated embodiment of FIG. 1, the water, along with any scale and sludge, drained from the steam generator 60 drains into a rear portion of the tub 14 and directly to the sump 38, bypassing the drum 16 and the fabric treatment chamber.

The steam generator cleaning step 104 can optionally include introduction of one or more chemicals to facilitate cleaning of the steam generation chamber 74. For example, vinegar (i.e., acetic acid) or other acids can be employed to help clean, de-scale, and de-calcify the steam generation chamber 74. The chemical can be introduced at any suitable time, such as during the steps 152, 164 of introducing water during the steam generator cleaning step 104.

Figure 8:
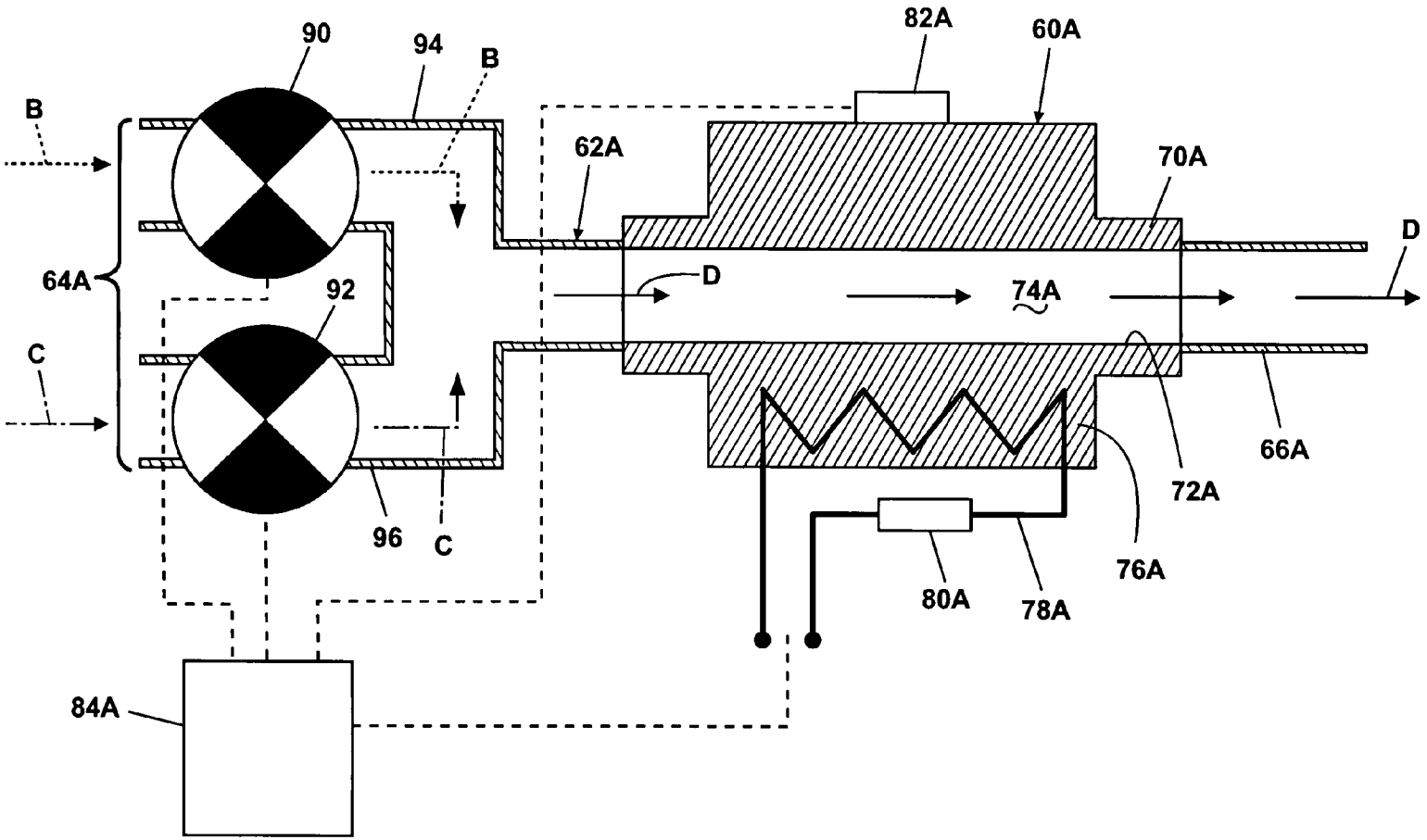
FIG. 8 is a schematic view of a second embodiment steam generator according to one embodiment of the invention for use with the washing machine of FIG. 1.

The method 100 can be executed with any type of steam generator, and the in-line steam generator 60 of FIG. 2 provides only one example; another exemplary steam generator 60A, an in-line steam generator, is illustrated in FIG. 8, wherein components similar to those of the first embodiment steam generator 60 are identified with the same reference numeral followed by the letter "A." The second embodiment steam generator 60A is substantially identical to the first embodiment steam generator 60, except that the latter receives water through a second inlet valve assembly 64A having a plurality of valves rather than the single inlet valve 64.

The second inlet valve assembly 64A comprises a first valve 90 and a second valve 92. The first valve 90 controls the flow of water through a first inlet branch 94 of the second supply conduit 62A, and the second valve 92 controls the flow of water through a second inlet branch 96 of the second supply conduit 62A. The first and second inlet braches 94, 96 join at a Y-connection upstream from the steam generation chamber 74A. The flow of water through the first valve 90 and the second valve 92 are respectively represented by dotted arrows B and dash-dot-dash arrows C in FIG. 8. The water flow downstream of the Y-connection and the steam flow are represented by solid arrows D.

The first valve 90 has a corresponding first flow rate, while the second valve 92 has a corresponding second flow rate different than the first flow rate. The flow rates can be selected based on a desired flow rate for different steps of the method 100. For example, the first valve 90 can be used for the steam generation step 102 when a relatively low flow rate is desired, while the second valve 92 can be used during the steam generator cleaning step 104 when a relatively high flow rate is desired, such as for the flushing of the steam generation chamber 74A. Using a relatively high flow rate during the steam generator cleaning step 104 can contribute to a more effective cleaning of the steam generation chamber 74A. As the flow rate increases, erosion of scale from the inside surface 72A of the steam generation chamber 74A can increase. As examples, the first flow rate can be about 0.25 liters per minute (LPM), and the second flow rate can be about 10 LPM. Similar to the second inlet valve 64 of the first embodiment steam generator 60, the first and second valves 90, 92 of the second inlet valve assembly 64A can be operated in any suitable manner, such as according to a duty cycle or in a continuous mode.

Figure 9:
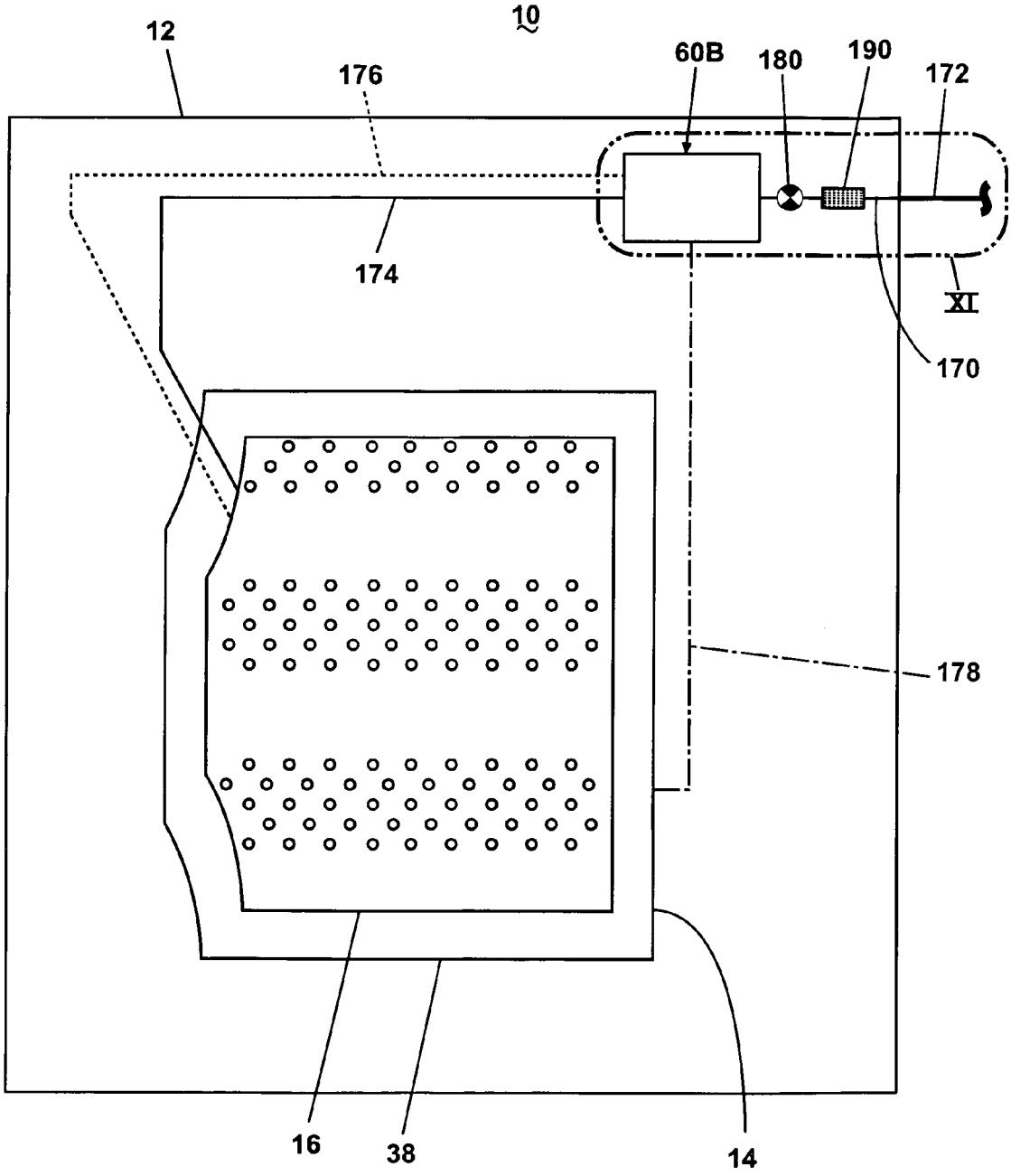
FIG. 9 is a schematic view of the steam washing machine of FIG. 1 with a third embodiment steam generator according to one embodiment of the invention.
Figure 10:
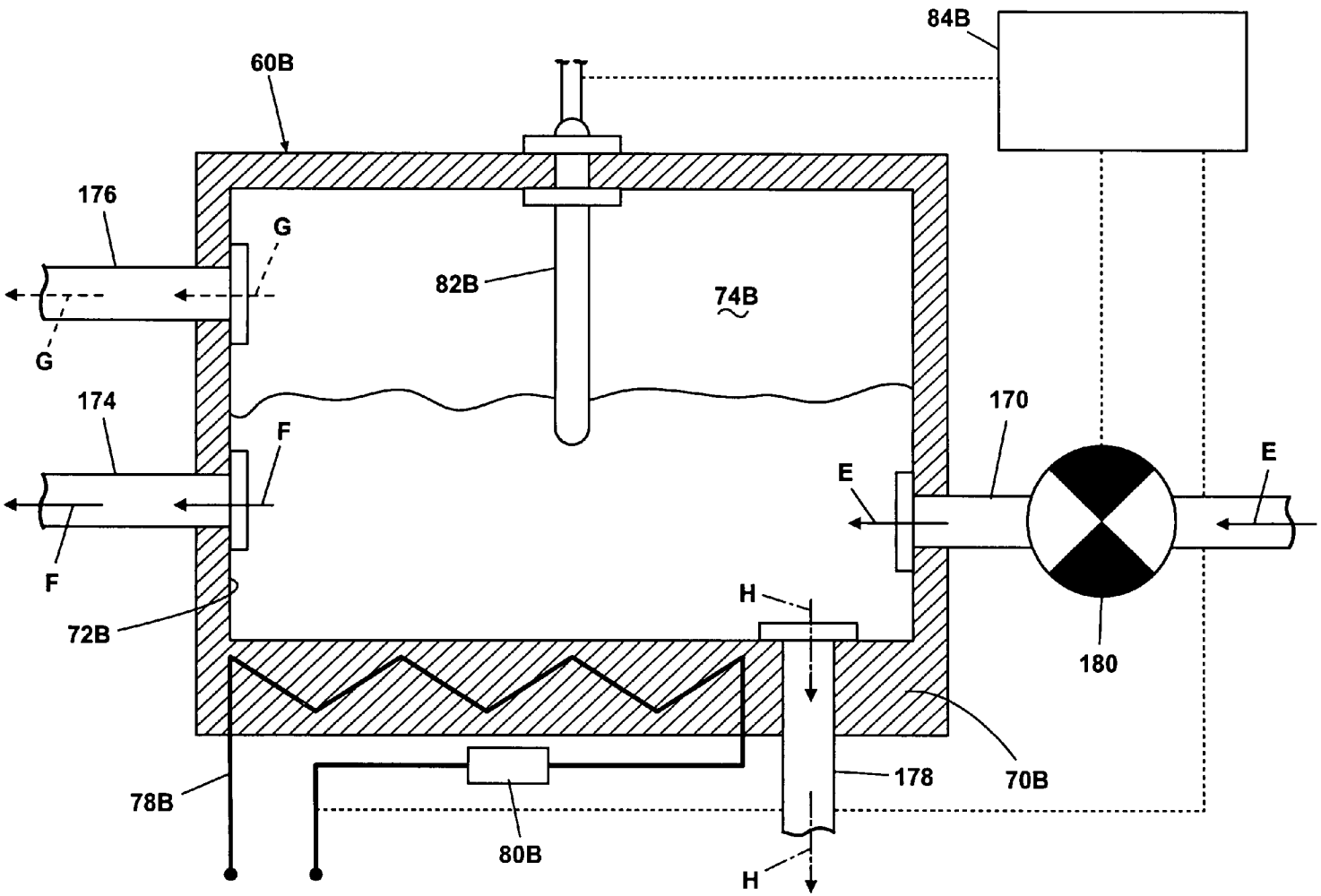
FIG. 10 is a schematic view of the third embodiment steam generator from FIG. 9.

FIG. 9 illustrates the washing machine 10 with a third embodiment steam generator 60B, which is shown in detail in FIG. 10, that can be used to execute the method 100. FIG. 9 is a schematic diagram and only shows the cabinet 12, the tub 14, the drum 16, the steam generator 60B, and fluid/steam conduits for the steam generator 60B. The fluid/steam conduits comprise a water supply line 170 that couples a household water supply 172 with the steam generator 60B, a water outlet line 174 that fluidly couples the steam generator 60B with the drum 16 for transporting water from the steam generator 60B to the drum 16, a steam outlet line 176 that fluidly couples the steam generator 60B with the drum 16 for transporting steam from the steam generator 60B to the drum 16, and a drain conduit 178 that fluidly couples the steam generator 60B with the tub 14. A supply valve 180 in the water supply line 170 controls the flow of fluid through the water supply line 170 to the steam generator 60B and can be operated in a manner similar to the second supply valve 64 of FIGS. 1 and 2. The supply valve 180 can optionally be replaced with a valve assembly similar to the second supply valve assembly 64A of FIG. 8. The water outlet line 174 and the steam outlet line 176 can alternatively be coupled to the tub 14 rather than the drum 16, and the coupling of the water outlet line 174 and the steam outlet line 176 to the tub 14/drum 16 can be located in any position on the tub 14/drum 16. Although not shown in the figures, the water outlet line 174, the steam outlet line 176, and the drain conduit 178 can include valves to control the flow of liquid and steam therethrough.

Referring now to FIG. 10, the steam generator 60B is a tank type steam generator comprising a housing or main body 70B in the form of a generally rectangular tank. The main body 70B has an inside surface 72B that defines a steam generation chamber 74B. The steam generation chamber 74B is fluidly coupled to the water supply line 170 such that fluid from the water supply line 170 can flow through the supply valve 180 and can enter the steam generation chamber 74B, as indicated by the solid arrows E entering the steam generation chamber 74B in FIG. 10. The steam generation chamber 74B is also fluidly coupled to the water outlet line 174 such that water from the steam generation chamber 74B can flow through the water outlet line 174 to the drum 16, as indicated by solid arrows F leaving the steam generation chamber 74B. Similarly, the steam generation chamber 74B is fluidly coupled to the steam outlet line 176 such that steam from the steam generation chamber 74B can flow through the steam outlet line 176 to the drum 16, as depicted by dotted arrows G in FIG. 10. Finally, the steam generation chamber 74B is fluidly coupled to the drain conduit 178 such that drain water can flow out of the steam generation chamber 74B through the drain conduit 178. The flow of drain water out of the steam generation chamber 74B is represented by dash-dot-dash arrows H in FIG. 10.

The steam generator 60B further comprises a heater 78B, which is shown as being embedded in the main body 70B. It is within the scope of the invention, however, to locate the heater 78B within the steam generation chamber 74B or in any other suitable location in the steam generator 60B. When the heater 78B is embedded in the main body 70B, the main body 70B is made of a material capable of conducting heat. For example, the main body 70B can be made of a metal, such as aluminum. As a result, heat generated by the heater 78B can conduct through the main body 70B to heat fluid in the steam generation chamber 74B. The heater 78B can be any suitable type of heater, such as a resistive heater, configured to generate heat. A thermal fuse 80B can be positioned in series with the heater 78B to prevent overheating of the heater 78B.

The steam generator 60B further includes a temperature sensor 82B that can sense a temperature of the steam generation chamber 74B or a temperature representative of the temperature of the steam generation chamber 74B. The temperature sensor 82B of the illustrated embodiment is a probe-type sensor that projects into the steam generation chamber 74; however, it is within the scope of the invention to employ temperature sensors in other locations. The temperature sensor 82B, the heater 78B, and the supply valve 180 can be coupled to a controller 84B, which can control the operation of heater 78B and the supply valve 180 in response to information received from the temperature sensor 82B.

The third embodiment steam generator 60B functions similarly to the first and second embodiment steam generators 60, 60A, except that the water and steam can leave the steam generation chamber 74B through different conduits rather than only flowing out of a single conduit. In particular, water, which can optionally be heated to form warm or hot water in the steam generation chamber 74B, intended for use in treating fabric can flow through the water outlet line 174, and steam intended for use in treating fabric can flow through the steam outlet line 176. Water not intended for use in treating fabric, such as water remaining in the steam generation chamber 74B after the steam generation step 102 or water flowing through the steam generation chamber 74B for the steam generator cleaning step 104, such as to flush the steam generation chamber 74B, can leave the steam generation chamber 74B through the drain conduit 178. In the illustrated embodiment of FIGS. 9 and 10, the drain water, along with any scale and the sludge removed during the steam generator cleaning step 104, flows through the drain conduit 178 and into the tub 14. Because the drain conduit 178 couples with the tub 14 at a rear portion of the tub 14, the water, along with the scale and the sludge, flows to the sump 38 without entering the drum 16. The rear portion of the drum 16 shields the fabric treatment chamber from the water, scale, and sludge mixture. Consequently, the water, scale, and sludge, does not contact fabric items in the drum 16 when flowing from the steam generator 60B to the sump 38. Furthermore, if the steam generator 60B is positioned above the connection between the drain conduit 178 and the tub 14, then the water can flow to the tub 14 by gravity. Such is the case in the illustrated embodiment as the steam generator 60B is positioned above the tub 14.

While only the tank-type steam generator 60B has been shown as comprising the different outlets for the steam, for the water intended for use in treating the fabric, and for the water not intended for use in treating the fabric, it is within the scope of the invention for an in-line steam generator to comprise the different outlets. It is further contemplated that either type of steam generator can comprise a liquid inlet, an outlet coupled to at least one of the tub 14 and the drum 16 for both steam and water intended for use in treating the fabric, and a drain for draining water not intended for use in treating the fabric.

Figure 11:
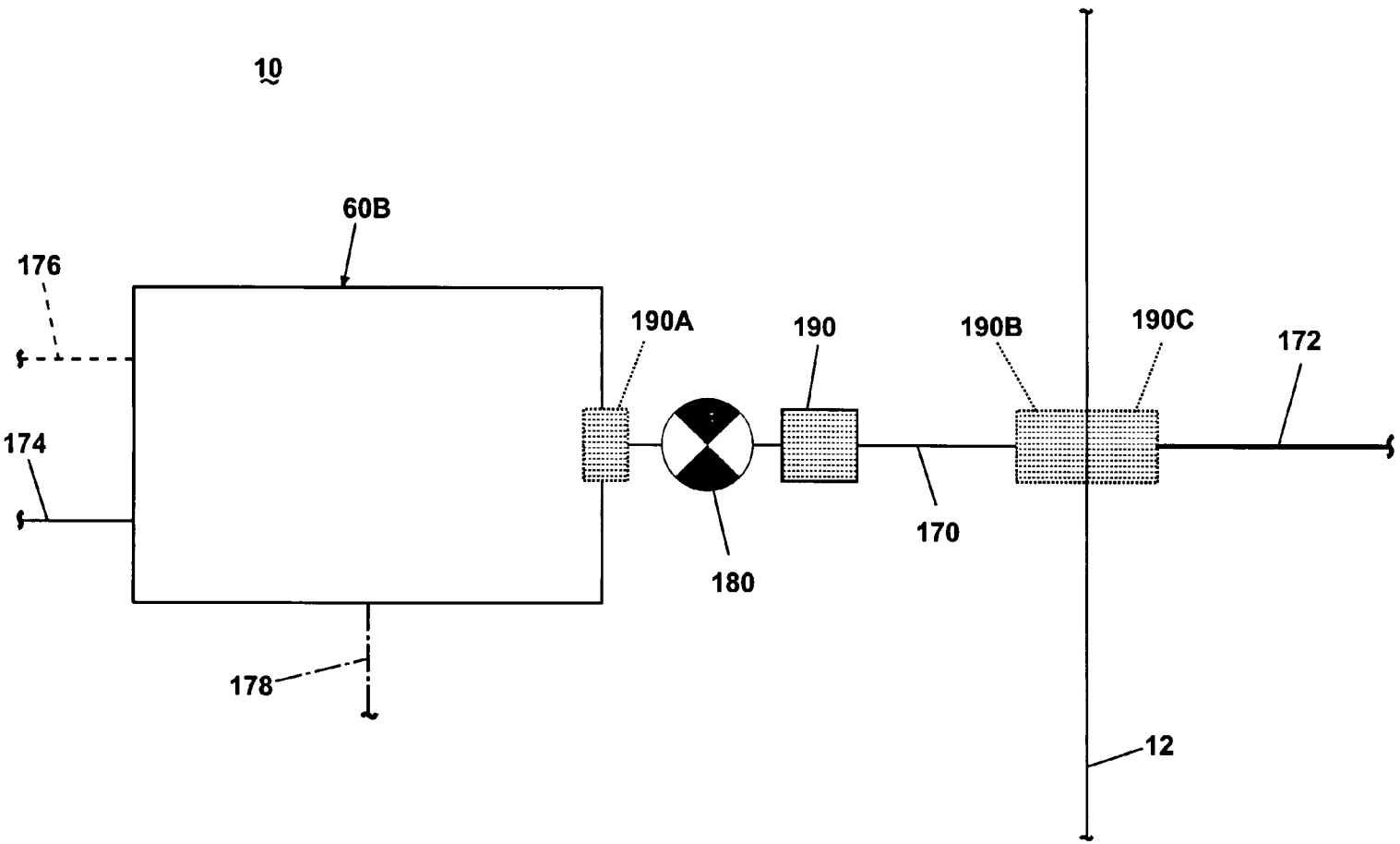
FIG. 11 is an enlarged view of an area labeled XI in FIG. 9 and showing optional locations for a filter in a water supply line upstream from the steam generator.

To prevent formation of scale and sludge, the water that enters the steam generation chamber 74B can be filtered, purified, or otherwise cleaned prior to entering the steam generation chamber 74B to remove or reduce the impurities necessary for the formation of scale and sludge. To illustrate this concept schematically, a portion of the washing machine 10 in FIG. 9 has been enlarged in FIG. 11. The washing machine 10 comprises a filter 190 fluidly coupled to the water supply line 170 to filter the water that flows from the household water supply 172 and through the water supply line 170 to the steam generator 60B. The filter 190 can be positioned in any suitable location, such as in the water supply line 170 between the household water supply 172 and the steam generator 60B, as shown in FIG. 11, at a connection between the water supply line 170 and the steam generator 60B (either integrated into the steam generator 60B or separate from the steam generator 60B), as shown by reference numeral 190A, and at a connection between the water supply line 170 and the household water supply 172, as shown by reference numerals 190B and 190C. The filter 190B is located inside the cabinet 12 of the washing machine 10, while the filter 190C is located at least partially externally of the cabinet 12 yet integrated with the washing machine 10.

Figure 12:
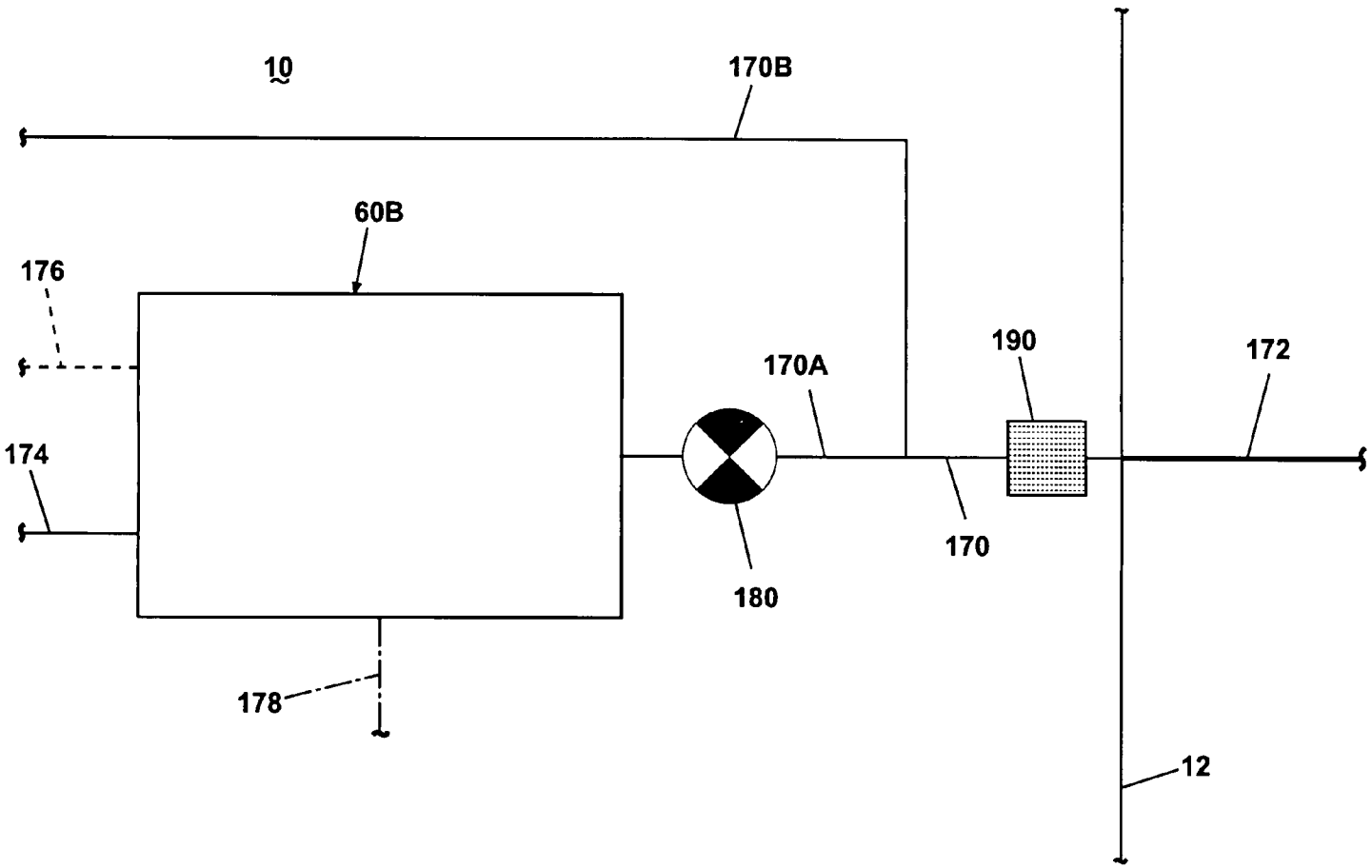
FIG. 12 is a view similar to FIG. 11 illustrating an alternative water supply line with the filter.

The water supply line 170 of FIG. 11 provides water only to the steam generator 60B; therefore, the filter 190 filters only the water that is provided to the steam generator 60B, which prolongs the life of the filter 190. Alternatively, the water supply line 170 can be configured to provide water to both the steam generator 60B and to other components of the liquid supply and recirculation system, as illustrated schematically in FIG. 12. In the embodiment of FIG. 12, the water supply line 170 branches at a Y-connection into a steam generator water supply line 170A, which provides water to the steam generator 60B, and an auxiliary water supply line 170B, which can provide water to, for example, a detergent dispenser, the tub 14, and/or the drum 16. The filter 190 can be positioned upstream from the Y-connection such that the filter 190 treats the water supplied to both the steam generator water supply line 170A and the auxiliary water supply line 170B. Alternatively, the filter 190 can be positioned downstream of the Y-connection to filter only the water provided to the steam generator 60B.

The filter 190 can be any suitable type of filter for removing impurities from water. For example, the filter 190 can comprise an ion exchange resin; a reverse osmosis filter; a catalytic alloy, such as nickel and palladium in various configurations, such as beads, pellets, and rods; a zeolite; and a nano- or ultra-filtration technique device. The filter 190 can also remove the impurities by using non-filter techniques, such as permanent magnets, electrostatic treatment devices, and mechanical precipitation devices, which filter the impurities mechanically by inducing flow patterns and vortices.

Depending on the type of filter technology employed, the washing machine 10 can include additional features for use with the filter 190. For example, a pump can be used to force the water through the filter 190 if the filter 190 is associated with a high pressure drop. The washing machine 10 can also include a reservoir to store filtered water upstream of the steam generator. When the reservoir is employed, the water can be filtered at any time and stored in the reservoir so that a stored volume of filtered water is available for use by the steam generator at all times. Alternatively, the water can be filtered in situ as the water is provided directly from the household water supply to the steam generator during operation of the steam generator.

The filter 190 can be replaceable and/or regenerable. When the filter 190 is replaceable, the entire filter 190 can be removed and replaced with a replacement filter. Alternatively, a filter media of the filter 190 can be replaced with a new filter media rather than replacing the entire filter 190. To facilitate replacement of the filter 190, the filter 190 can be coupled to the water supply line 170 in any suitable manner, such as by a quick-fit connection, including, but not limited to, a bayonet connection, a screw connection, and a snap-fit connection. When the filter 190 is regenerable, the filter 190 can be regenerated while coupled to the water supply line 170 or while removed from the water supply line 170.

The filter 190 can be employed with any type of steam generator and is not intended to be limited for use with the third embodiment steam generator 60B. Rather, the filer 190 can be utilized in combination with an in-line steam generator, such as the first and second embodiment steam generators 60, 60A, another tank-type steam generator, or any other kind of steam generator.

To reduce build-up of scale in the steam generator 60B, the inside surface 72B of the steam generation chamber 74B can have a surface treatment that reduces the tendency of the scale to bond with the inside surface 72B. The surface treatment can be applied to the entire inside surface 72B or only a portion of the inside surface 72B. The surface treatment can comprise any suitable surface treatment, such as a material added to the inside surface 72B in the form of a coating, a material embedded into the inside surface 72B, or a treatment that alters a texture of the inside surface 72B. As an example, the surface treatment can comprise polytetrafluoroethylene (PTFE), commonly known as Teflon®. The PTFE can be used as a surface treatment alone or in combination with other materials. For example, the PTFE can be impregnated into an anodized coating, such as an anodized aluminum coating. A commercial example of a PTFE-impregnated anodized coating is Nituff®, available from Nimet Industries. As another example, the PTFE can constitute part of coating having a nickel and phosphorous matrix, and a commercial example of such a coating is NiCoTef®, which is also available from Nimet Industries. The coating can be deposited with any suitable process, and the coating comprising the nickel and phosphorous coating and PTFE is especially suitable for deposition with electroless nickel plating.

The surface treatment can be employed with any type of steam generator and is not intended to be limited for use with the third embodiment steam generator 60B. Rather, the surface treatment can be utilized in combination with an in-line steam generator, such as the first and second embodiment steam generators 60, 60A, another tank-type steam generator, or any other kind of steam generator.

Other structures and methods related to scale and sludge control in steam washing machines are disclosed in the following patent applications, which are incorporated herein by reference in their entirety: our Docket Number US20050472, titled "Prevention of Scale and Sludge in a Steam Generator of a Fabric Treatment Appliance;" and our Docket Number US20060227, titled "Draining Liquid From a Steam Generator of a Fabric Treatment Appliance," both filed concurrently herewith.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a fabric treatment appliance comprising at least one of a tub or drum defining a fabric treatment chamber and a steam generator having a chamber defining an internal volume, the method comprising:

a steam generation step comprising:

introducing liquid into the chamber of the steam generator;

heating the liquid in the chamber to create steam;

introducing the steam into the fabric treatment chamber; and after the steam generation step, a steam generator cleaning step comprising:

heating the chamber, without the introduction of liquid, to a predetermined temperature greater than a liquid to steam phase transformation temperature to evaporate any liquid in the chamber;

turning off the heater;

cooling the heating chamber by introducing cold liquid at a temperature less than the predetermined temperature into the chamber whereby cooling of the heated chamber thermally shocks scale formed in the chamber to thereby cause the scale to delaminate from an inside surface of the chamber to form loose scale in the chamber; and flushing the chamber with cold liquid to rinse the loose scale out of the chamber.

2. The method of claim 1, wherein the introducing of the liquid during the steam generation step comprises introducing a volume of liquid less than or equal to the internal volume.

3. The method of claim 1, wherein the flushing of the chamber comprises continuously introducing the liquid into the chamber.

4. The method of claim 1, wherein the introducing of the liquid during the steam generation step comprises intermittently introducing the liquid into the chamber.

5. The method of claim 1, wherein the predetermined temperature is about 200° C.

6. The method of claim 1, wherein the cold liquid is liquid from a cold water supply of a household water supply.

7. The method of claim 1, wherein the introducing of the liquid during the steam generation step comprises introducing the liquid at a first flow rate, and the flushing of the chamber comprises introducing the liquid at a second flow rate greater than the first flow rate.

8. The method of claim 1, wherein the flushing of the chamber occurs until the temperature of the chamber decreases to a predetermined temperature.

9. The method of claim 1, wherein the flushing of the chamber occurs for a predetermined time.

10. The method of claim 1, wherein the flushing of the chamber results in introducing the liquid into the tub.

11. The method of claim 1, wherein the flushing of the chamber occurs following at least one of a wash step, a rinse step, a spin step, a drying step, a revitalization step, and a manual user flush command.

* * * * *